US010631631B1

(12) United States Patent
Pei

(10) Patent No.: US 10,631,631 B1
(45) Date of Patent: Apr. 28, 2020

(54) GAS-OPERATED LIFTING TABLE

(71) Applicant: Xubo PEI, Shenzhen (CN)

(72) Inventor: Xubo Pei, Shenzhen (CN)

(73) Assignee: Xuan Pei, Shenzhen (CN)

( * ) Notice: Subject to any disclaimer, the term of this patent is extended or adjusted under 35 U.S.C. 154(b) by 0 days.

(21) Appl. No.: 16/249,921

(22) Filed: Jan. 17, 2019

(30) Foreign Application Priority Data

Nov. 20, 2018 (CN) ..... 2018 1 13878578

(51) Int. Cl.

| | |
|---|---|
| ***A47B 9/10*** | (2006.01) |
| ***B66F 3/24*** | (2006.01) |
| ***A47B 13/02*** | (2006.01) |
| ***A47B 9/20*** | (2006.01) |
| ***B66F 3/28*** | (2006.01) |

(52) U.S. Cl.
CPC ..... *A47B 9/10* (2013.01); *A47B 9/20* (2013.01); *A47B 13/023* (2013.01); *B66F 3/247* (2013.01); *B66F 3/28* (2013.01)

(58) Field of Classification Search
CPC ..... A47B 9/10; A47B 9/20; A47B 13/023; A47B 2200/0051; A47C 3/40; B66F 3/28; B66F 3/247
USPC ..... 108/147, 147.19; 248/188.5, 188.2
See application file for complete search history.

(56) References Cited

U.S. PATENT DOCUMENTS

| | | | | | |
|---|---|---|---|---|---|
| 4,667,605 | A * | 5/1987 | Bastian | A47B 9/20 | 108/106 |
| 6,092,474 | A * | 7/2000 | Chen | A47B 9/10 | 108/147 |
| 6,182,583 | B1 * | 2/2001 | Larson | A47B 9/10 | 108/147 |
| 6,189,843 | B1 * | 2/2001 | Pfister | A47B 9/083 | 248/157 |
| 6,397,761 | B1 * | 6/2002 | Moore | A47B 9/10 | 108/147 |
| 9,743,755 | B2 * | 8/2017 | Lin | B66F 3/26 | |
| 10,107,448 | B1 * | 10/2018 | Hung | A47B 9/20 | |
| 10,226,119 | B1 * | 3/2019 | Ko | A47B 9/20 | |
| 10,342,327 | B2 * | 7/2019 | Lin | A47B 9/10 | |
| 2002/0050112 | A1 * | 5/2002 | Koch | A47B 9/20 | 52/651.07 |
| 2003/0116066 | A1 * | 6/2003 | Ken | A47B 9/08 | 108/147 |

(Continued)

*Primary Examiner* — Jose V Chen
(74) *Attorney, Agent, or Firm* — Dave Law Group LLC; Raj S. Dave

(57) ABSTRACT

A gas-operated lifting table provided by an embodiment of the present disclosure, includes a pedestal, a column assembly, and a panel assembly, the column is detachably coupled to the pedestal and the panel assembly, the panel assembly includes an operating member, the column assembly includes a fastening column fastened to the pedestal and a sliding column movable relative to the fastening column, the gas-operated lifting table further includes a controllable gas spring arranged within the column assembly and detachably coupled to the column assembly, when the operating member is pressed against the controllable gas spring, the sliding column is movable relative to the fastening column in a direction away from or toward the pedestal. The gas-operated lifting table provided by an embodiment of the present disclosure has a simple structure and is flexible to operate.

20 Claims, 16 Drawing Sheets

(56) References Cited

U.S. PATENT DOCUMENTS

| | | | | |
|---|---|---|---|---|
| 2005/0012430 | A1* | 1/2005 | Bastholm | A47B 9/20 310/311 |
| 2012/0043436 | A1* | 2/2012 | Atkinson | A47B 9/20 248/188.5 |
| 2014/0241789 | A1* | 8/2014 | Chiu | F16B 7/1454 403/109.1 |
| 2015/0047538 | A1* | 2/2015 | Ergun | A47B 9/02 108/147 |
| 2016/0281912 | A1* | 9/2016 | Christen | F16M 11/26 |
| 2016/0296006 | A1* | 10/2016 | Bonuccelli | A47B 9/20 |
| 2017/0350552 | A1* | 12/2017 | James | F16M 11/42 |
| 2018/0064241 | A1* | 3/2018 | Tseng | A47B 9/10 |
| 2018/0092457 | A1* | 4/2018 | Lai | A47B 9/10 |
| 2018/0213927 | A1* | 8/2018 | Sudoh | A47B 9/10 |
| 2018/0271733 | A1* | 9/2018 | Davis | A61G 13/06 |
| 2018/0303233 | A1* | 10/2018 | DeGroot | A47B 9/20 |
| 2019/0191866 | A1* | 6/2019 | Lin | A47B 9/04 |
| 2019/0357668 | A1* | 11/2019 | Knudtson | A47C 3/40 |

* cited by examiner

GAS-OPERATED LIFTING TABLE

CROSS REFERENCE TO RELATED APPLICATION(S)

This application claims benefit of priority under 35 U.S.C. § 119 of China Patent Application No. 2018113878578, filed on Nov. 20, 2018, the contents of which are hereby incorporated by reference in its entirety.

TECHNICAL FIELD

The present disclosure relates to office furniture, more particularly to a gas-operated lifting table.

BACKGROUND

Gas-operated lifting tables are common office furniture. The gas-operated lifting tables may be adjusted at different heights and folded up to saves space. Therefore, it is easy to use and widely favored by users. However, controllable gas springs of the related gas-operated lifting tables are fixedly connected to a column assembly and an operating member, thus in replacement or maintenance of the controllable gas springs, needing disassemble the column assembly and the operating member simultaneously, and thereby existing complexity, installation and dismantling inconvenient of the gas-operated lifting tables.

SUMMARY

In view of the above problems in the prior art, embodiments of the present disclosure provide a gas-operated lifting table having a simple structure and being easy to install and disassemble.

In addition, an embodiment of the present disclosure provides a gas-operated lifting table, includes a pedestal, a column assembly, and a panel assembly, the column is detachably coupled to the pedestal and the panel assembly, the panel assembly includes an operating member, the column assembly includes a fastening column fastened to the pedestal and a sliding column movable relative to the fastening column, the gas-operated lifting table further includes a controllable gas spring arranged within the column assembly and detachably coupled to the column assembly, when the operating member is pressed against the controllable gas spring, the sliding column is movable relative to the fastening column in a direction away from or toward the pedestal.

Compared with the related art, the gas-operated lifting table is provided by the embodiment of the present disclosure. The column assembly is detachably coupled to the pedestal and the panel assembly, the panel assembly includes a operating member, the column assembly includes a fastening column fastened to the pedestal and a sliding column movable relative to the fastening column, the gas-operated lifting table further includes a controllable gas spring arranged within the column assembly and detachably coupled to the column assembly, when the operating member is pressed against the controllable gas spring, the sliding column is movable relative to the fastening column in a direction away from or toward the pedestal. Since the controllable gas spring is detachably coupled to the column assembly and isolated from the operating member, the gas-operated lifting table may have a simple structure and may be easy to install and disassemble.

BRIEF DESCRIPTION OF THE DRAWINGS

In order to more clearly illustrate the embodiments of the present disclosure or the technical solutions in the related art, the drawings to be used in the embodiments or the description of the related art will be briefly described below. Obviously, the accompanying drawings in the following description are only some embodiments of the present disclosure, those skilled in the art can also obtain other drawings pedestal on these drawings without paying any creative work.

DETAILED DESCRIPTION

The technical solutions in the embodiments of the present disclosure will be clearly and completely described in the following with reference to the accompanying drawings in the embodiments.

It will be appreciated that, the terms used herein are for the purpose of describing particular embodiments, and are not intended to limit the present disclosure. As used herein, the singular forms "a" and "the" are intended to include the plural forms as well, unless the context clearly states otherwise. Furthermore, when the terms are used in the specification, the terms "comprises" and/or "comprising," when used in this specification, specify the presence of stated features, products, steps, operations, elements, and/or components, but do not preclude the presence or addition of one or more other features, products, steps, operations, elements, components, and/or groups thereof. The descriptions of the present disclosure are intended to be illustrative of the preferred embodiments of the present disclosure, and are not intended to limit the scope of the present disclosure. The scope of protection of the present disclosure is subject to the definition of the appended claims.

Figure 1:
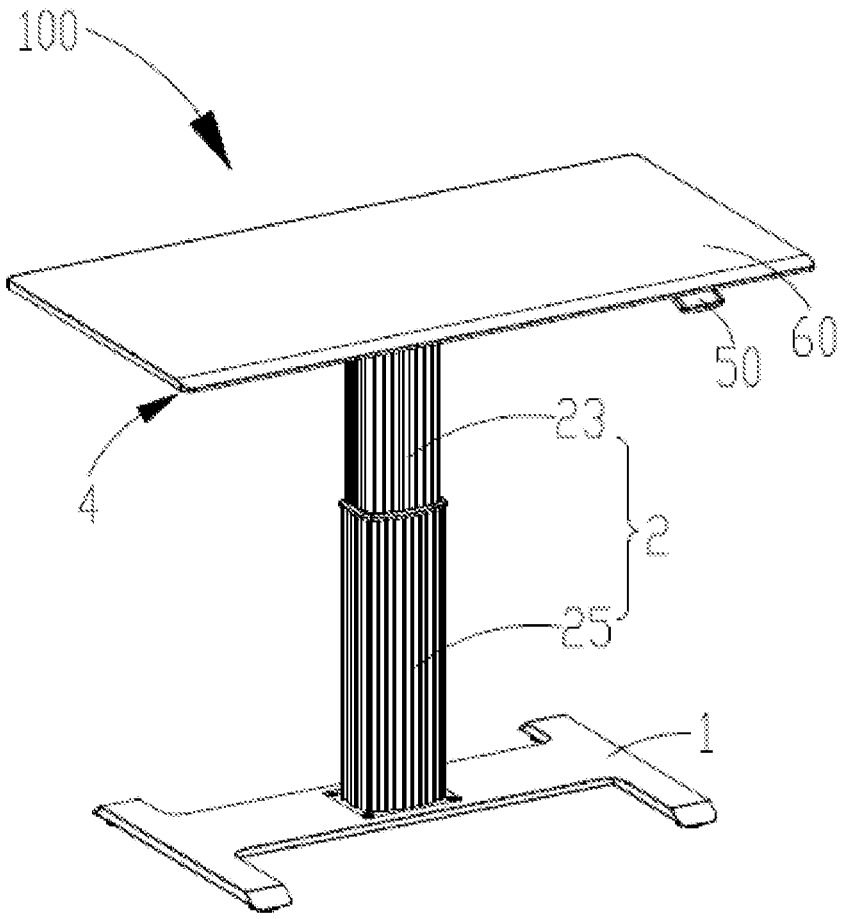
FIG. 1 is a schematic structural view of a gas-operated lifting table provided by one exemplary embodiment of the present disclosure.

As illustrated in FIG. 1, FIG. 1 is a schematic structural view of a gas-operated lifting table 100 provided by one exemplary embodiment of the present disclosure. It will be appreciated that, a gas-operated lifting table is, but is not limited to, an office table, a desk, a dining table, a computer desk, and the like. The gas-operated lifting table 100 includes a pedestal 1, a column assembly 2, and a panel assembly 4. The column 2 is detachably connected to the pedestal 1 and the panel assembly 4. The panel assembly 4 includes an operating member 50. The column assembly 2 includes a fastening column 21 fastened to the pedestal 1 and a sliding column 23 movable relative to the fastening column 21. The gas-operated lifting table 100 further includes a controllable gas spring 3 arranged within the column assembly 2 and detachably connected to the column assembly 2, and when the operating member 50 is pressed against the controllable gas spring 3, the sliding column 23 is movable relative to the fastening column 21 in a direction away from or toward the pedestal 1. It will be appreciated that, in the embodiment, when the sliding column 23 moves relative to the fastening column 21 in a direction away from or toward the pedestal 1, the panel assembly 4 is driven to move away from or toward the pedestal 1 to change a height of the gas-operated lifting table 100.

In the embodiment, a height of the gas-operated lifting table 100 varies in response to a movement of the sliding column 23 relative to the fastening column 21 toward or away from the pedestal 1, and an adjustable height is substantially in a range from 75 cm to 120 cm. In this way, the user can adjust the height of the gas-operated lifting table 100 according to an actual condition. For example, when the height of the gas-operated lifting table 100 is adjusted to 120 cm, the gas-operated lifting table 100 is suitable for standworking, thus avoiding straining the body due to sedentary, and thereby increasing work productivity. Furthermore, since the operating member 50 and the controllable gas spring 3 are separately arranged on the panel assembly 4 and the column assembly 2, thus the gas-operated lifting table 100 may be convenient to install and disassemble, and a problem, that in the process of disassembling or assembling the gas-operated lifting table 100, the controllable gas spring 3 is easily triggered to operate by a misoperation of the operating member 50 because of a fixed connection between the operating member 50 and the controllable gas spring 3, may be avoided. In addition, the height of the gas-operated lifting table 100 provided by the embodiment of the present disclosure can be adjusted and stopped at any position within an adjustable range by the controllable gas spring 3 to adapt to different applications.

Figure 2:
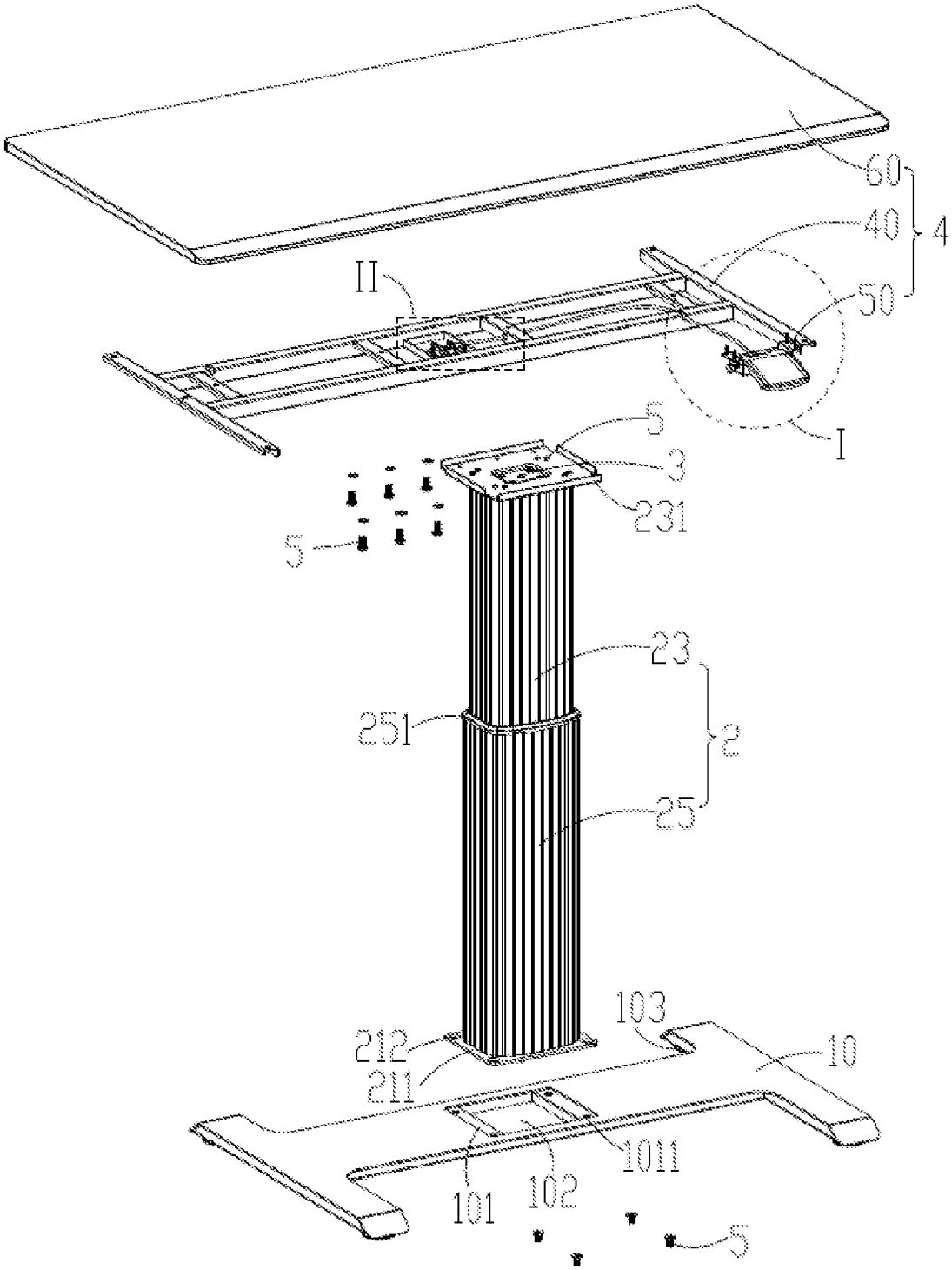
FIG. 2 is an exploded perspective view of the gas-operated lifting table of FIG. 1.

As illustrated in FIG. 2, in the embodiment, the pedestal 1 is substantially H-shaped. A positioning groove 101 is defined on a top portion of the pedestal 1. A positioning plate 211 received in the positioning groove 101 is arranged on a bottom of the fastening column 21 of the column assembly 2. In an embodiment, the positioning plate 211 is detachably connected to the fastening column 21. In the embodiment, the positioning plate 211 is fastened to the fastening column 21 by a plurality of screwing members 5. It will be appreciated that, the screwing members 5 are, but are not limited to, a screw, a pin, a snap or a magnetically absorbing structure. The above category of the screwing members 5 are applicable to other screwing members described in some embodiments of the present disclosure. In some variant embodiments, the positioning plate 211 and the fastening column 21 are made in one piece.

An edge of the positioning plate 211 is exposed to the fastening column 21, that is, a projection of the fastening column 21 in a direction of a central axis thereof falls within the positioning plate 211. The positioning slot 101 is arranged on an intermediate position of the pedestal 1, such that when the column assembly 2 is fastened to the pedestal 1 by the positioning plate 211, the gas-operated lifting table 100 is integrally balanced, thereby improving the stability of the gas-operated lifting table 100. A bottom of the positioning groove 101 defines an opening 102 penetrating through the pedestal 1. In the embodiment of the present disclosure, the first opening is the opening 102. Thus, when the column assembly 2 is fastened on the pedestal 1, the controllable gas spring 3 exposed at the bottom of the column assembly 2 can be correspondingly received in the opening 102 to reduce the occupation of the controllable gas spring 3 in the gas-operated lifting table 100. A plurality of screwing holes 1011 are defined at the bottom of the positioning groove 101 adjacent to the opening 102. A plurality of through holes 212 are defined at positions of the positioning plate 21 corresponding to the plurality of screwing holes 1011. The plurality of screwing members 5 are correspondingly passed through the through holes 212 and screwed in the screwing holes 1011, thus the fastening column 21 is fastened on the pedestal 1. In the embodiment, a plurality of through holes 212 are located in a region where the positioning plate 211 does not cover the fastening column 21. Furthermore, a plurality of supporting blocks 103 are arranged on a bottom of the pedestal 1 to smoothly support the gas-operated lifting table 100. Each of the supporting blocks 103 can also be a roller or an adjustment foot.

Figure 3:
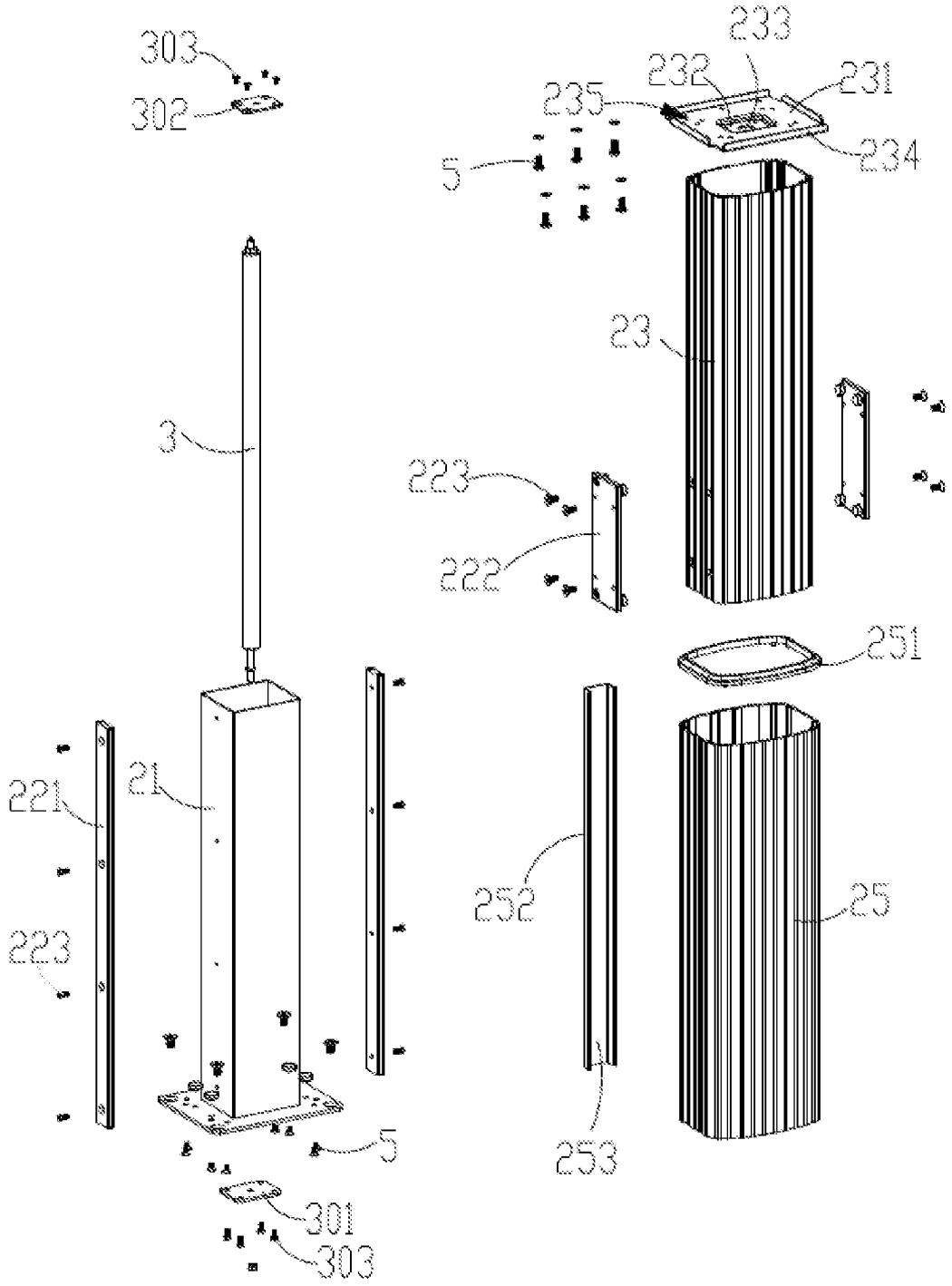
FIG. 3 is an exploded perspective view of a first perspective of a column assembly and a controllable gas spring of the gas-operated lifting table of FIG. 2.
Figure 9:
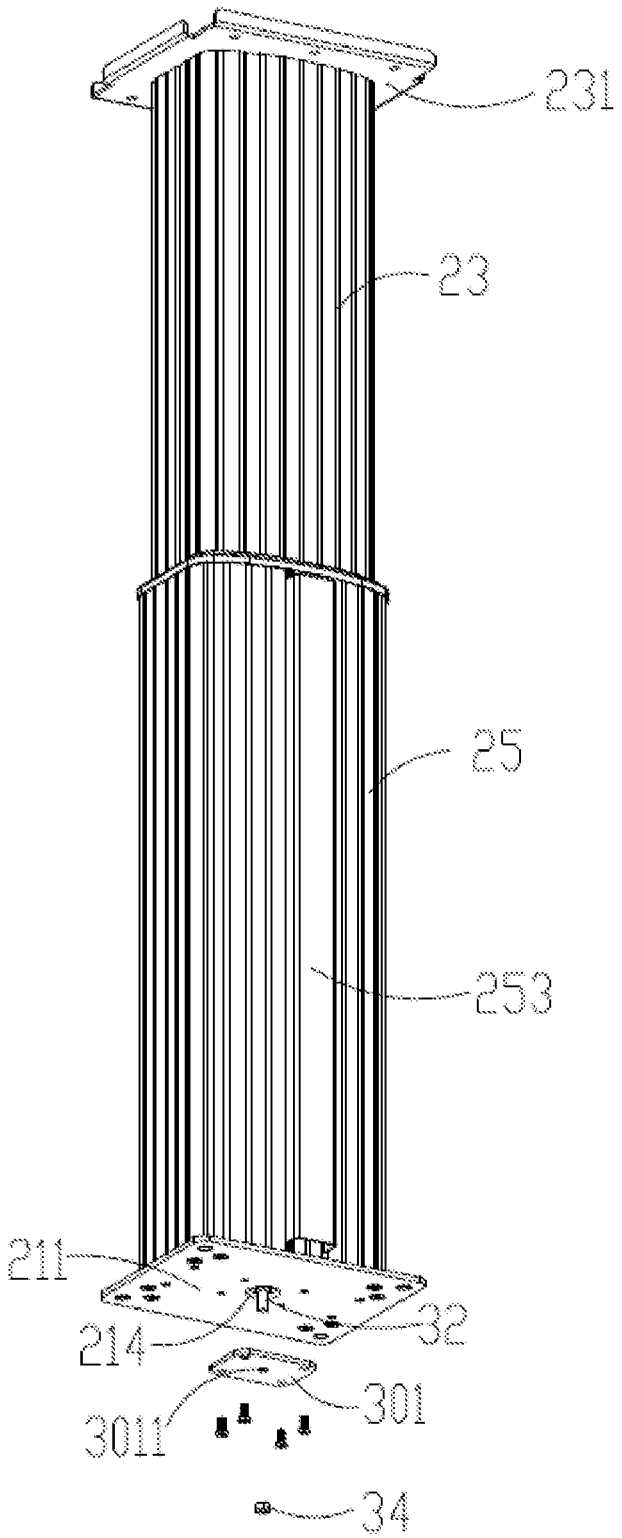
FIG. 9 is an exploded perspective view of a second perspective of the column assembly and a controllable gas spring of the gas-operated lifting table of FIG. 2.
Figure 10:
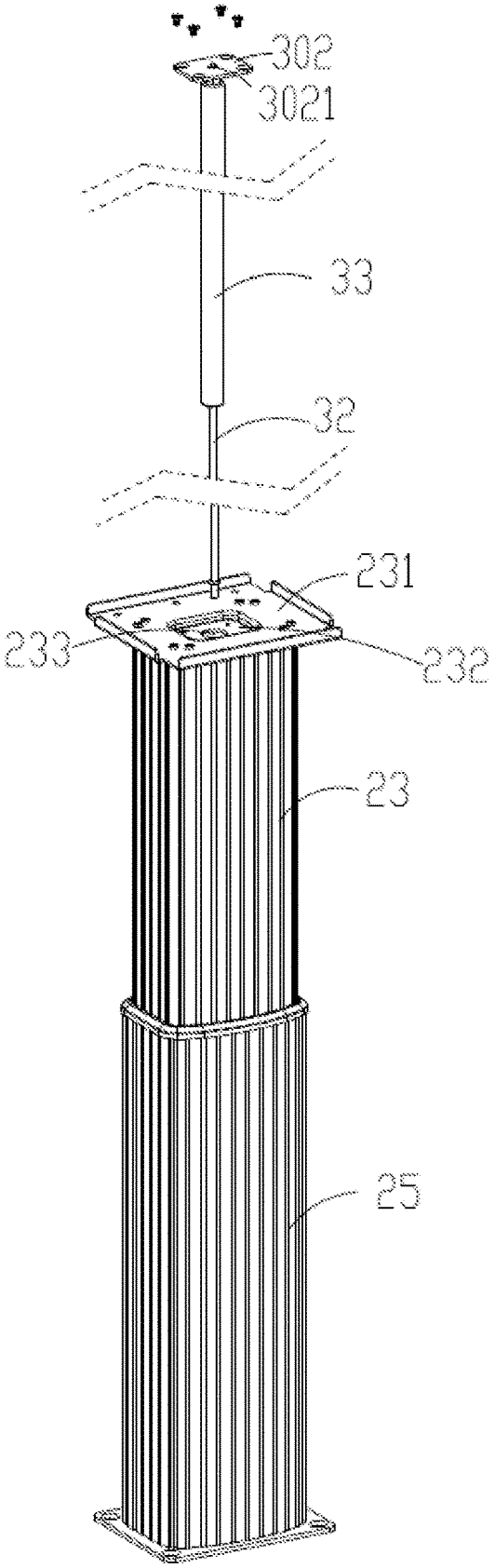
FIG. 10 is an exploded perspective view of a third perspective of a column assembly and a controllable gas spring of the gas-operated lifting table of FIG. 2.
Figure 11:
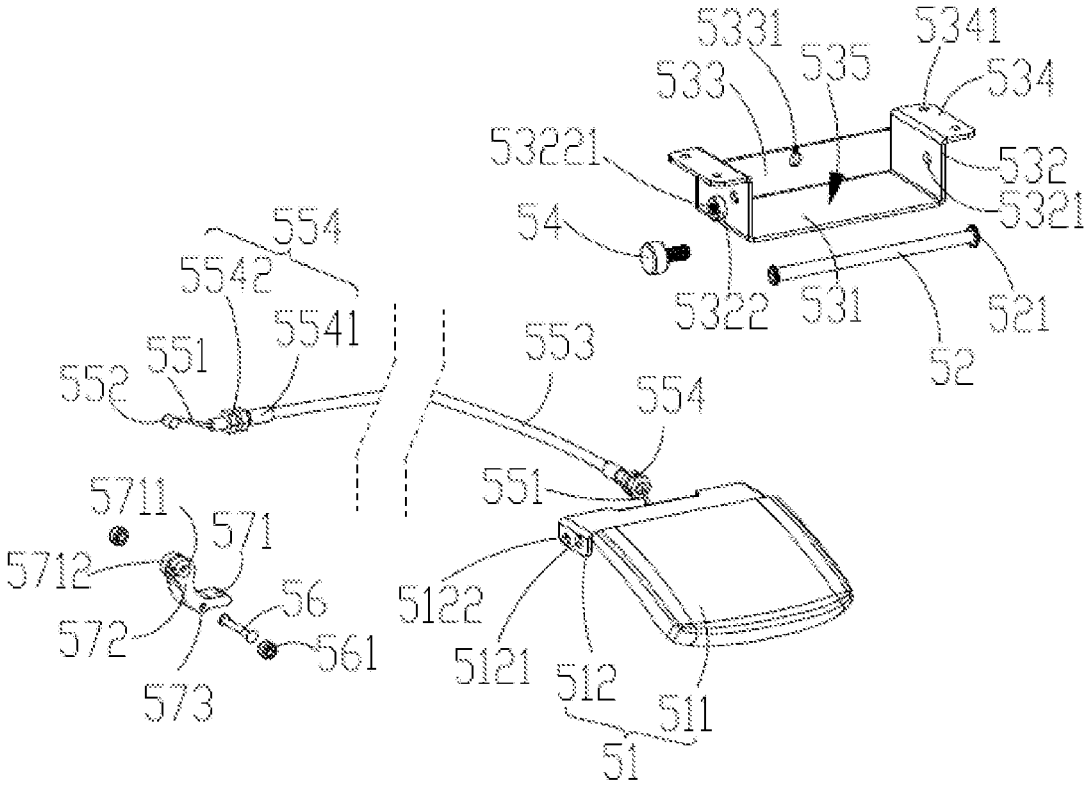
FIG. 11 is an exploded perspective view of an operating member of the gas-operated lifting table of FIG. 2.
Figure 12:
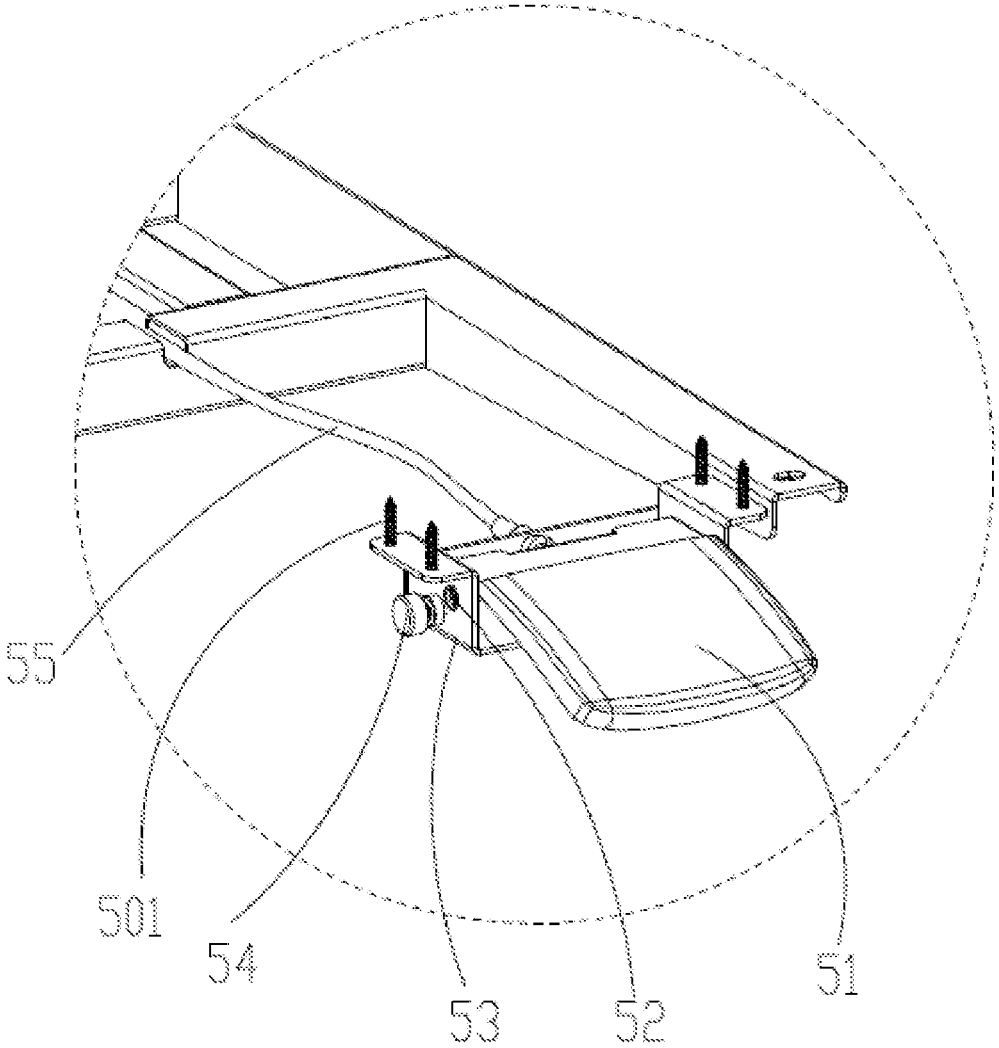
FIG. 12 is an enlarged view of a portion I of FIG. 2.
Figure 13:
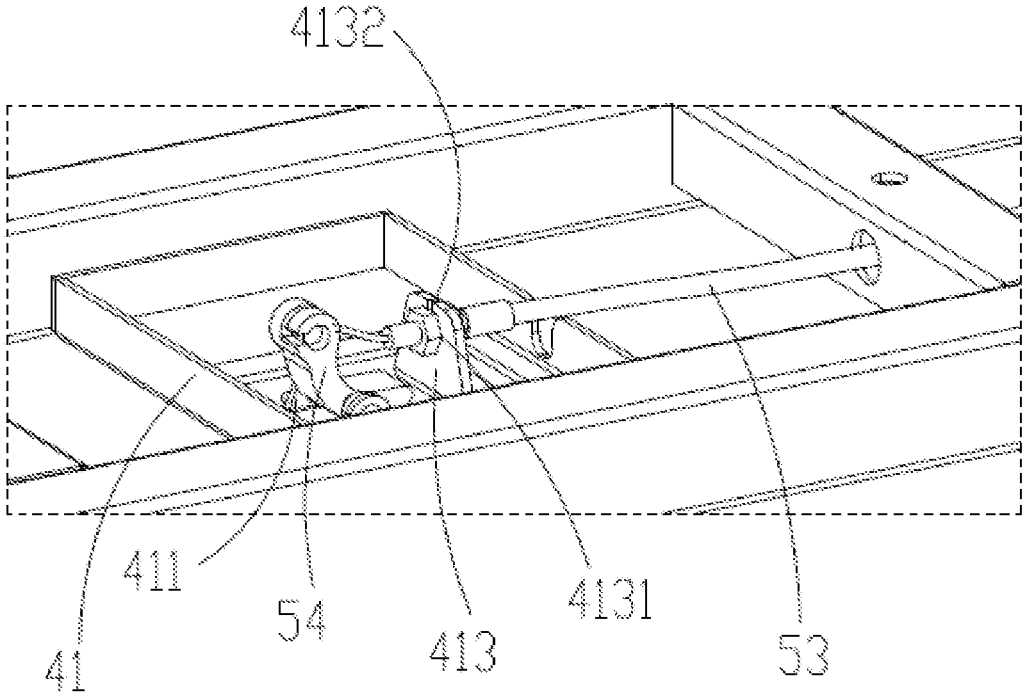
FIG. 13 is an enlarged view of a portion II of FIG. 2.
Figure 14:
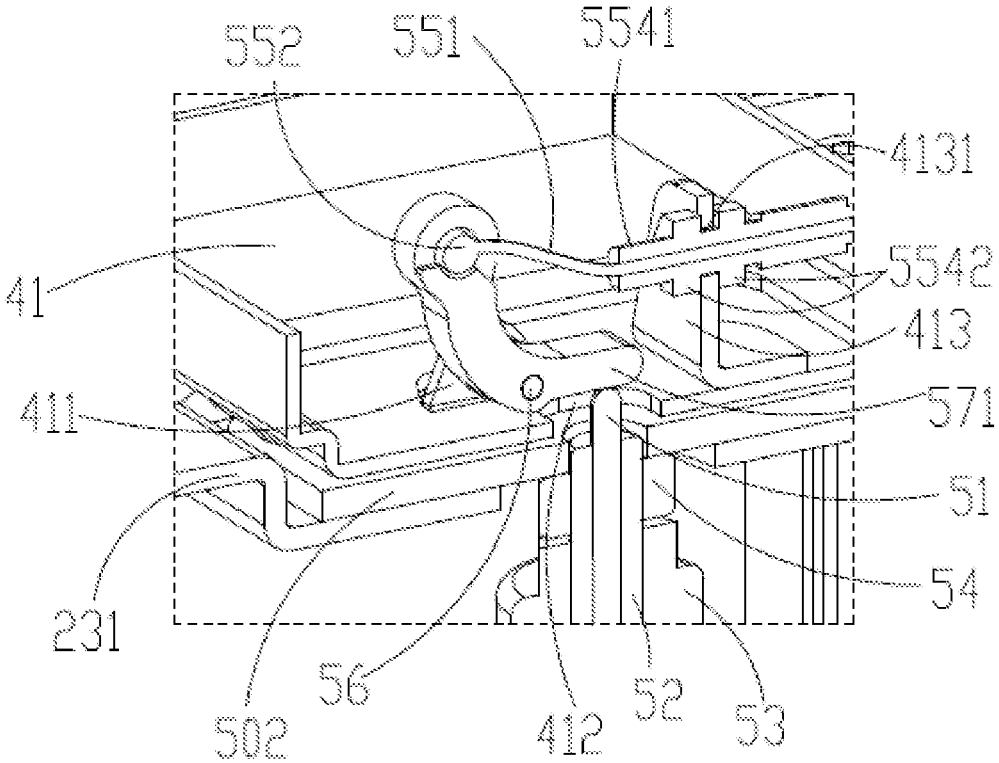
FIG. 14 is a partial cross-sectional view showing the gas-operated lifting table of FIG. 1 in an initial state.
Figure 15:
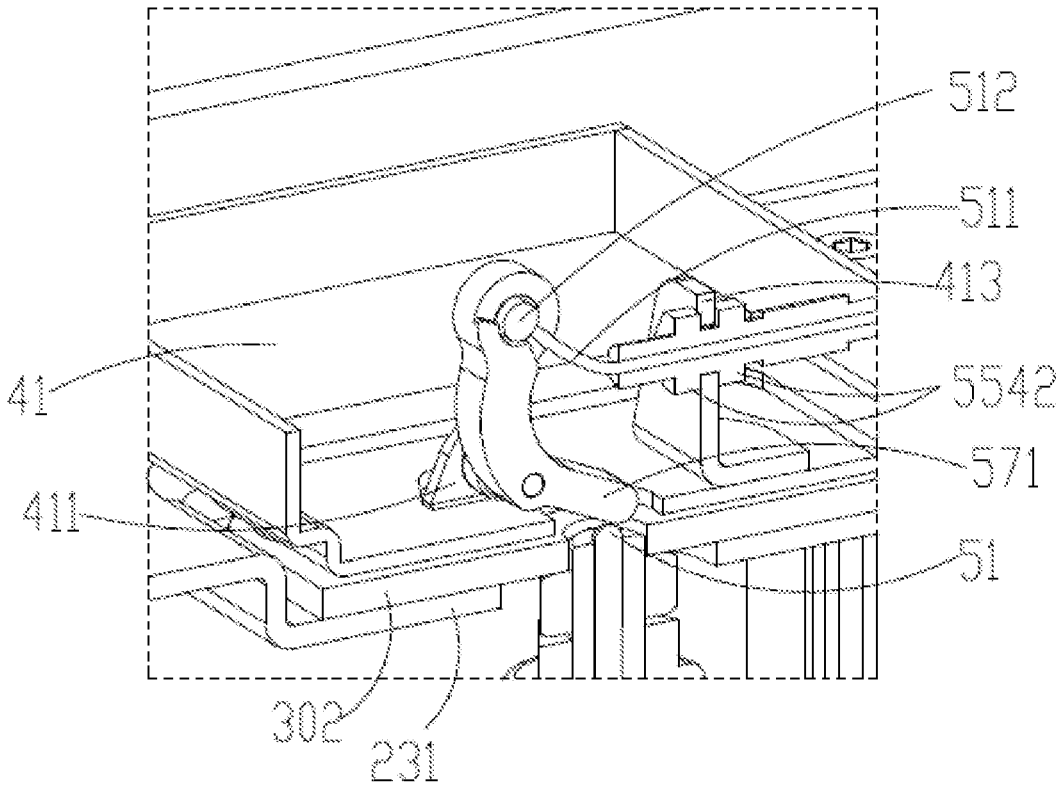
FIG. 15 is a partial cross-sectional view of a gas-operated lifting table of FIG. 1 in an adjusting state.

As illustrated in FIG. 3, in the embodiment, the controllable gas spring 3 includes a first connecting member 301. The controllable gas spring 3 is detachably connected to the positioning plate 211 by the first connecting member 301. A region of the positioning plate 211 covering the fastening column 21 defines a through hole 214 (see FIG. 9), and a bottom end of the controllable gas spring 3 is passed through the through hole 214 and fixedly connected to the first connecting member 301. In the embodiment, the first connecting member 301 is fastened to a side of the positioning plate 211 away from the fastening column 21 by a plurality of screwing members 303.

Figure 4:
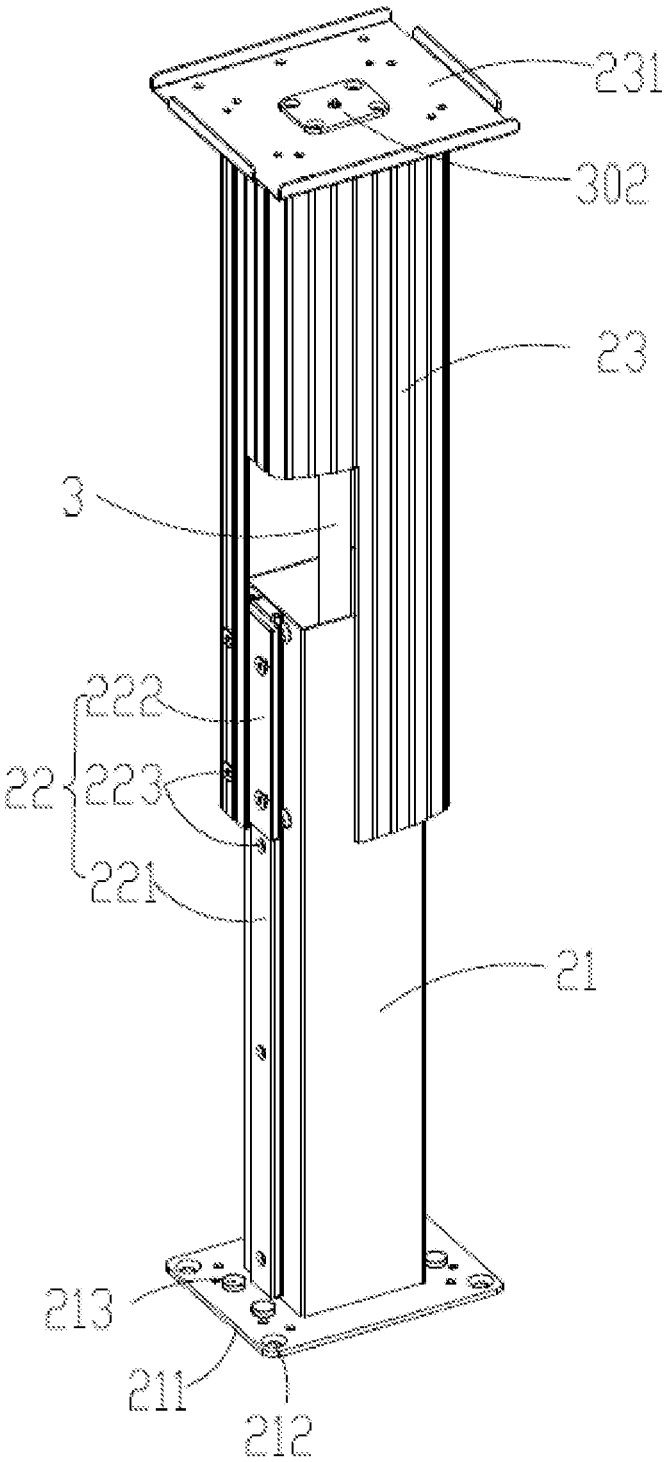
FIG. 4 is an exploded perspective view of the column assembly of the gas-operated lifting table omitting a sleeve of FIG. 1.

As illustrated in FIG. 3 to FIG. 4, the column assembly 2 further includes a sliding member 22 arranged between the fastening column 21 and the sliding column 23. The sliding column 23 is sleeved on the fastening column 21 and slidably connected to the fastening column 21 by the sliding member 22. In the embodiment, the number of the sliding member 22 is two, and the two sliding members 22 are symmetrically arranged relative to a central axis of the fastening column 21. It will be appreciated that, in other embodiments, the number of the sliding member 22 may be one or more. In the embodiment of the present disclosure, the number of the sliding member 22 is not limited.

Figure 5:
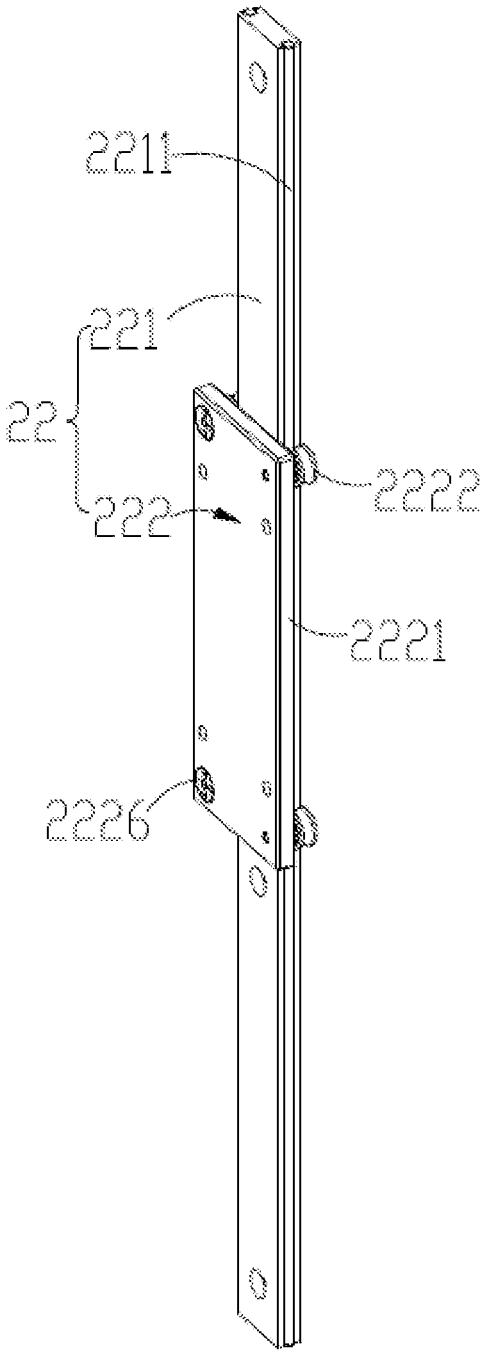
FIG. 5 is a schematic structural view of a sliding member of the column assembly of the gas-operated lifting table of FIG. 2.
Figure 6:
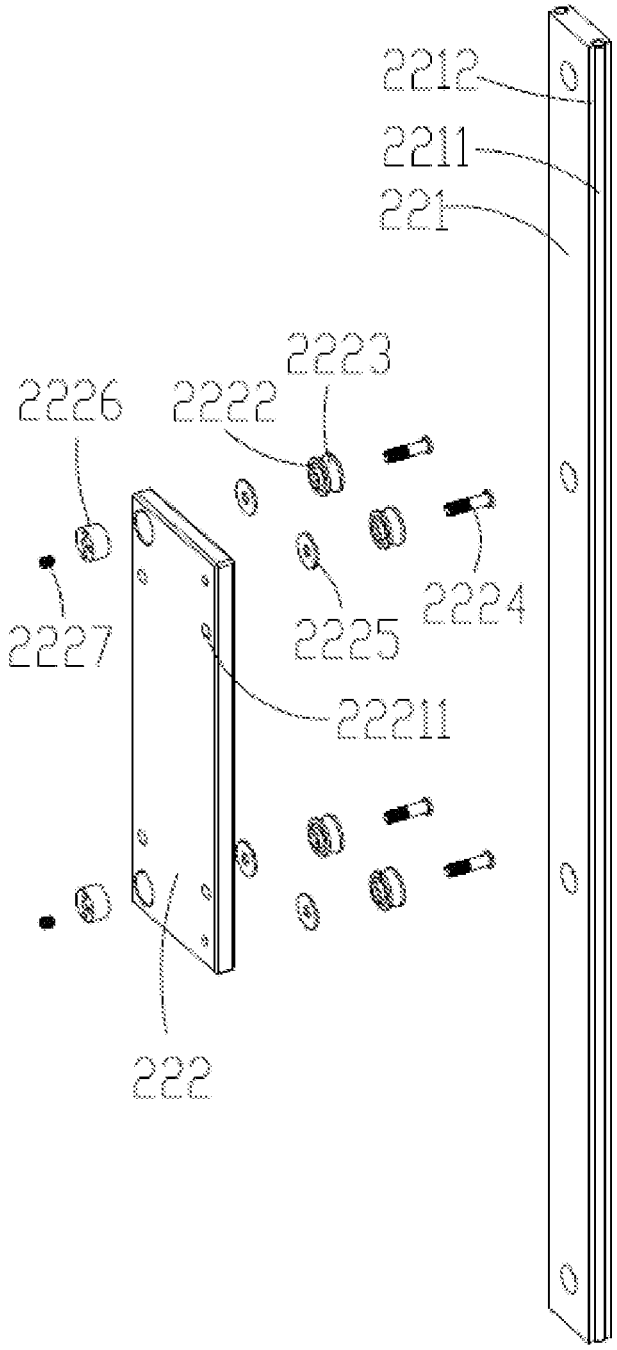
FIG. 6 is an exploded perspective view of the sliding member of the column assembly of the gas-operated lifting table of FIG. 5.

As illustrated in FIG. 5 to FIG. 6, each of the sliding members 22 includes a first guide rail 221, a second guide rail 222 engaged with the first guide rail 221, and a plurality of screwing members 223. The first guide rail 221 is arranged on an outside wall of the fastening column 21 and is fastened to the fastening column 21 by the plurality of screwing members 223. A length of the first guide rail 221 is substantially less than or equal to a height of the fastening column 21. The first guide rail 221 is substantially in a long strip shape. A longitudinal direction of the first guide rail 221 is parallel to a central axis of the fastening column 21. The second guide rail 222 is arranged on an inside wall of the sliding column 23 and located at an end of the sliding column 23 adjacent to the pedestal 1. The second guide rail 222 includes a mounting plate 2221 and at least two ball bearings 2222 arranged on a side of the mounting plate 2221 away from the sliding column 23. The first guide rail 221 is arranged between the at least two ball bearings 2222 and slidably engaged with the at least two ball bearings 2222. The mounting plate 2221 is fastened to the sliding column 23 by the plurality of screwing members 223, and at least two ball bearings 2222 are slidably engaged with the first guiding rail 221 to make the sliding column 23 slide relative to the fastening column 21 by at least two ball bearings 221. The at least two ball bearings 2221 are located at positions of the mounting plate 2221 corresponding to both side edges of the first guide rail 221. A distance between the two ball bearings 2222 perpendicular to a sliding direction of the sliding column 23 is substantially equal to a width of the first guide rail 221, thus the roller bearings 2222 can slide relative to the first guide rail 221. A width direction of the mounting plate 2221 refers to a direction perpendicular to the central axis of the sliding column 23.

In an alternative embodiment, two guide bars 2211 are respectively arranged on the two opposite sides of the first guide rail 221 along a length direction thereof. An exposed surface of each of the guide bars 2211 exposed on the first guide rail 221 is a substantially circular arc shape. Each of the ball bearings 2222 defines a groove 2223 for engaging with the guide bar 2211. In the embodiment, four ball bearings 2222 are arranged on the mounting plate 2221. A thickness of each of the ball bearings 2222 is substantially equal to a thickness of the first guide rail 221 to ensure the smoothness of the second guide rail 222 sliding relative to the first guide rail 221. It will be appreciated that, the thickness of each ball bearing 2222 refers to a maximum distance between two opposite endpoints of each ball bearing 2222 in a direction of a center line axis thereof, and the thickness of the first guide rail 221 refers to a maximum distance between two opposite endpoints of the first guide rail 221 in a width direction thereof.

It will be appreciated that, in the embodiment, the guide bar 2211 of the first guide rail 221 may be a cylindrical rod embedded in the sidewall of the first guide rail 221, that is, the guide bar 2211 is detachably connected to the first guide rail 221. Specifically, the sidewall of the first guide rail 221 defines a slot 2212 for receiving the guide bar 2211. The slot 2212 is substantially semi-cylindrical, to make the guide bar 2211 expose on the side wall of the first guide rail 221, thus the guide bar 2211 of the first guide rail 221 may be engaged with the groove 2223 of the ball bearing 2222. It will be appreciated that, in order to increase a hardness of the first guide rail 221, the rod may be preferably a chrome rod. In other embodiments, the guide bar 2211 of the first guide rail 221 may also be a protrusion protruding from the side wall of the first guide rail 221, that is, the guide bar 2211 and the first guide rail 221 are made in one piece.

Each of the ball bearings 2222 is fixed to the mounting plate 2221 by a screwing member 2224. Specifically, each of the ball bearings 2222 defines a through hole 22221 in an axial direction thereof. The mounting plate 2221 defines a screwing hole 22211 at a position corresponding to the through hole 22221, and the screwing member 2224 is passed through the through hole 22221 of the ball bearing 2222 and screwed in the screwing hole 22211 of the mounting plate 2221. In the embodiment, the screwing member 2224 is a screw. Furthermore, a spacer 2225 is arranged between each of the ball bearings 2222 and the mounting plate 2221, thus reducing a friction between the ball bearing 2222 and the mounting plate 2221, and thereby reducing a noise of the sliding column 23 sliding relative to the fastening column 21.

In an alternative embodiment, a plurality of adjusting members 2226 are arranged on a side of the mounting plate 2221 adjacent to the sliding column 23. The plurality of adjusting members 2226 are configured to adjust a distance between the first guide rail 221 and the second guide rail 222, to make the guide rail 2211 of the first guide rail 221 engage with the at least two ball bearings 2222 of the second guide rail 222, thus avoiding a problem that the stability of the gas-operated lifting table 100 is poor and a loud noise is generated during the sliding column 23 moving relative to the fastening column 21 due to a space between the first guide rail 221 and the second guide rail 222. Each of the adjusting members 2226 is connected to the mounting plate 2221 by a fixing member 2227. In the embodiment, Each of the adjusting members 2226 is an adjusting nut, such as an eccentric wheels, and the fixing member 2227 is a set screw.

It will be appreciated that, in one alternatively embodiment, the second guide rail 222 includes a mounting plate 2221 and a U-shaped strip engaged with the first guide rail 221 and formed on two opposite sides of the mounting plates 2221. In another alternatively embodiment, two opposite sides of the first guide rail 221 defines two arc grooves, and protrusions correspondingly engaging with the grooves are arranged on the second guide rail 222.

Referring again to FIG. 2 and FIG. 3, a supporting plate 231 is arranged on a top end of the sliding column 23. The panel assembly 4 further includes a panel bracket 40. The sliding column 23 is connected to the panel bracket 40 of the panel assembly 4 by the supporting plate 231. In an embodiment, the supporting plate 231 is detachably connected to the slide post 23 and the panel bracket 40. In the embodiment, the supporting plate 231 is fixed to the sliding column 23 and the panel bracket 40 by the screwing member 5. It will be appreciated that, the screwing member 5 is, but is not limited to, a screw, a pin, a snap or a magnetically absorbing structure. In some alternative embodiments, the supporting plate 231 and the sliding column 23 are made in one piece. An edge of the supporting plate 231 is exposed to the slide post 23, that is, a projection of the slide post 23 in a direction of a central axis falls within the supporting plate 231. A receiving groove 232 is recessed at a side of the supporting plate 231 facing away from the column assembly 2. The receiving groove 232 is located in a region of the supporting plate 231 covered by the sliding column 23. In the embodiment, the controllable gas spring 3 further includes a second connecting member 302. The controllable gas spring 3 is fixedly connected to the supporting plate 231 by the second connecting member 302. The second connecting member 302 is received in the receiving groove 232 and detachably fixed to the supporting plate 231. The controllable gas spring 3 is fixed to the second connecting member 302 and detachably connected to the second connecting member 302. Furthermore, a bottom of the receiving groove 232 defines an opening 233 through the supporting plate 231. In the embodiment of the present disclosure, the second opening is the opening 233. A diameter of the opening 233 is larger than a maximum outer diameter of the controllable gas spring 3, thus the controllable gas spring 3 may pass through the opening 233, and the controllable gas spring 3 can be taken out or installed without disassembling the column assembly 2, and the efficiency of assembly and disassembly of the controllable gas spring 3 may be improved. The top end of the controllable gas spring 3 is passed through the opening 233 to be fixedly connected to the second connecting member 302, and exposed to the column assembly 2. In the embodiment, the second connecting member 302 is fixed to a side of the supporting plate 231 away from the sliding column 23 by a plurality of screwing members 303.

Furthermore, a limiting plate 234 is extended vertically up from an edge of the supporting plate 231. A limiting space 235 is cooperatively formed by the supporting plate 231 and the limiting plate 234. The second connecting member 302 and a top end of the controllable gas spring 3 exposed to the column assembly 2 are received in the limiting space 235, thus preventing a problem that, in the assembling process of the column assembly 2, the panel bracket 40 and the controllable gas spring 3, the top end of the controllable gas spring 3 exposed to the column assembly 2 abuts against the panel bracket 40 to make the sliding member 23 slide relative to the fastening column 21, and thereby improving the assembly efficiency and safety of the gas-operated lifting table 100.

The column assembly 2 further includes a sleeve 25 sleeved on an outside of the fastening column 21 and the sliding column 23. In the embodiment, the sliding column 23 is arranged between the fastening column 21 and the sleeve 25, that is, the sleeve 25 is arranged coaxially with the fastening column 21 and the sliding post 23. An annular sealing cover 251 is arranged on an end of the sleeve 25 away from the pedestal 1. The sealing cover 251 is detachably arranged on the sleeve 25. The sealing cover 251 is sleeved on the sliding column 23. An inner diameter of the seal cap 251 is substantially the same as an outer diameter of the sliding column 23. The sealing cover 251 is configured to shield the gap between the fastening column 21 and the sliding column 23, thus not only avoiding a problem that external dust and other impurities enter into the column assembly 2, and causing difficulty in cleaning, and a problem pinching hand during adjusting the height of the gas-operated lifting table 100, but also guiding a sliding direction of the sliding column 23 relative to the fastening column 21 and improving the overall appearance the gas-operated lifting table 100.

Furthermore, a bar frame 252 is further arranged on an outside of the sleeve 25. The bar frame 252 and the sleeve 25 cooperatively form a wiring duct 253. The bar frame 252 is substantially U-shaped. A cord of the gas-operated lifting table 100 can be stored in the wiring duct 253 to improve the overall appearance of the gas-operated lifting table 100.

Figure 7:
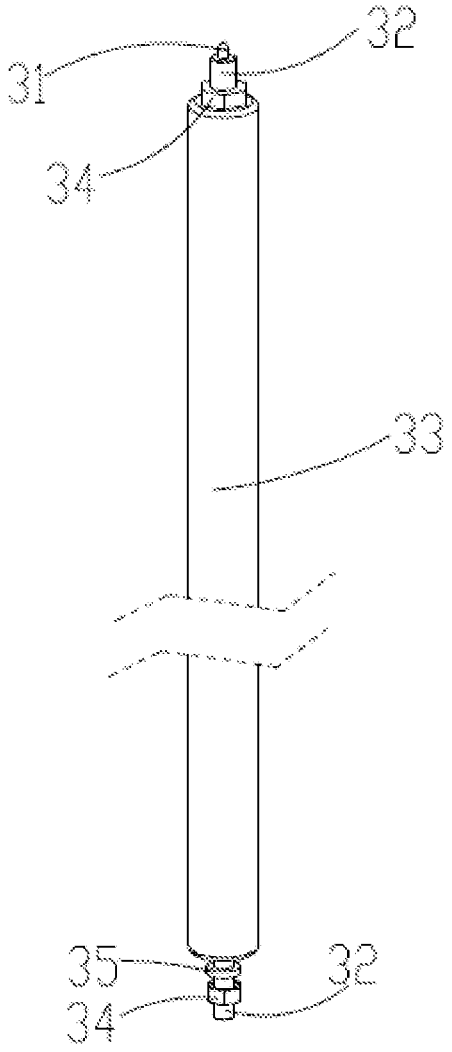
FIG. 7 is a schematic structural view of the controllable gas spring of the gas-operated lifting table of FIG. 1 in an initial state.
Figure 8:
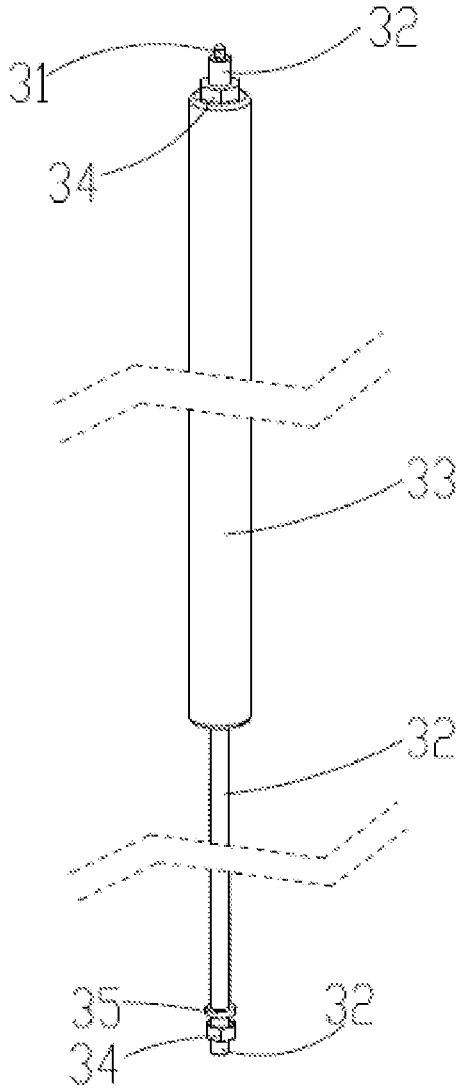
FIG. 8 is a schematic structural view of the controllable gas spring of the gas-operated lifting table of FIG. 1 in an adjusting state.

As illustrated in FIG. 7 and FIG. 8, the controllable gas spring 3 further includes a resettable pneumatic valve 31, an adjusting rod 32, and an adjusting sleeve 33. The pneumatic valve 31 is telescopically arranged within the adjusting rod 32 and exposed to a top end of the adjusting sleeve 33. The adjusting rod 32 is arranged within the adjusting sleeve 33 and is movable relative to the adjusting sleeve 33.

Furthermore, the controllable gas spring 3 further includes a plurality of positioning nuts 34. The positioning nut 34 is screwed with the adjusting sleeve 33. A top end of the adjusting rod 32 defines an external thread, and an internal thread of the positioning nut 34 is screwed with the external thread of the adjusting rod 32. A depth of the adjusting rod 32 inserting into the adjusting sleeve 33 is adjusted by the positioning nut 34, to determine an adjustable height range of the controllable gas spring 3. The adjustable height of the controllable gas spring 3 is substantially in a range from 0 to 450 mm.

As illustrated in FIG. 7 to FIG. 10, a bottom end of the adjusting rod 32 is fixed to the first connecting member 301. Specifically, the first connecting member 301 defines a through hole 3011 for passing through the adjusting rod 32. The bottom end of the adjusting rod 32 defines an external thread screwing with the inner thread of the positioning nut 34. The adjusting rod 32 may pass through the through hole 214 of the positioning plate 211. The bottom end of the adjusting rod 32 is sequentially passed through the through hole 214 of the positioning plate 211 and the through hole 3011 of the first connecting member 301 to be screwed to the positioning nut 34. In the embodiment, an outer diameter of the positioning nut 34 is substantially larger than a diameter of the through hole 3011 of the first connecting member 301, to make the positioning nut 34 stop the first connecting member 301, thus the bottom end of the adjusting rod 32 may be fixed on the positioning plate 211 of the fastening plate 21. Furthermore, a cushioning pad 35 is arranged on the bottom end of the controllable gas spring 3. The cushioning pad 35 is arranged between the adjusting sleeve 33 and the first connecting member 301. It will be appreciated that, the cushioning pad 35 is made from an elastic material. The elastic material is, but is not limited to, rubber, thermoplastic polymer, thus the cushioning pad 35 can provide a buffering force for the adjusting sleeve 33 in a descending process, thereby preventing a damage of the controllable gas spring 3 caused by the impact of the adjusting sleeve 33 colliding with the positioning plate 211. The top end of the adjusting rod 32 is fixedly connected to the second connecting member 302. Specifically, the second connecting member 302 defines a threaded hole 3021 screwing to the external thread of the adjusting rod 32 at a position corresponding to the adjusting rod 32.

Referring to FIG. 2, FIG. 7 and FIG. 8, it will be appreciated that, when the sliding column 23 is sleeved on the fixing column 21, that is, the bottom end of the sliding column 23 is in contact with the pedestal 1, the adjusting rod 32 is received within the adjusting sleeve 33. When the sliding column 23 slides away from the pedestal 1 relative to the fastening post 21, the adjusting rod 32 extends out of the adjusting sleeve 33, and a distance of the sliding column 23 movable relative to the fixed post 21 is substantially equal to a distance of the adjusting rod 32 extending from the adjusting sleeve 33.

Referring to FIG. 2 and FIG. 11 to FIG. 13, the panel assembly 4 further includes a panel 60. The panel bracket 40 is arranged between the panel 60 and the column assembly 2. The panel bracket 40 is substantially H-shaped. A mounting seat 41 is arranged on the panel bracket 30 at a position corresponding to the column assembly 2. Two opposite pivoting portions 411 are arranged on the mounting seat 41, which are arranged side by side. The operating member 50 includes a rotating shaft 56 and a moving member 57. The moving member 57 is rotatably connected to the two pivot portions 411 by a rotating shaft 56. Each of the pivoting portions 411 defines a shaft hole (not shown) for passing the rotating shaft 56. A straight line passing through a center of the two shaft holes is perpendicular to a moving direction of the moving member 57.

The operating member 50 further includes a handle 51, a rotating shaft 52, a fastening seat 53, a control member 54, and a cord 55. The handle 51 is rotatably connected to the fastening seat 53 by the rotating shaft 52, and is mounted on a back surface of the panel 60 by a fastening seat 53. The cord 55 is connected between the handle 53 and the moving member 57. The moving member 57 is linked with the handle 53 by the cord 55 to make the controllable gas spring 3 drive the sliding column 23 to move relative to the fastening column 21. The handle 51 is in a locked state or an unlocked state relative to the fastening seat 53 by operating the control member 54. Specifically, the control member 54 may be operated to lock the handle 51 and the fastening seat 53, or the control member 54 may also be operated to unlock the handle 51 and the fastening seat 53. In the locked state, the handle 51 is inactive; in the unlocked state, the handle 51 is movable, thus the moving member 57 and the handle 53 are linked with by the cord 55 to make the controllable gas spring 3 drive the sliding column 23 to move relative to the fastening column 21.

The handle 51 includes an operating portion 511 and a connecting portion 512 connected to the fastening seat 53. A shaft hole 5121 for passing through the rotating shaft 52 is defined on both sides of the connecting portion 512. The fastening seat 53 includes a bottom plate 531, two opposite side plates 532, and a back plate 534 connected to the bottom plate 531 and the two side plates 532. The bottom plate 531, the two side plates 532, and the back plate 534 collectively form a receiving space 535 for receiving the connecting portion 512 of the handle 51. Each of the side plates 532 defines a shaft hole 5321 passing through the rotating shaft 52. Two limiting blocks 521 are correspondingly arranged on both ends of the rotating shaft 52 stopped by the shaft hole 5321. The limiting block 521 is detachably connected to the rotating shaft 52. The rotating shaft 52 sequentially passes through the shaft hole 5321 of one of the side plates 532, the two shaft holes 5121 of the handle 51, and the shaft hole 5321 of the other side plate 532, thereby realizing the rotational connection of the handle 51 and the handle fixing seat 53. Furthermore, a fastening post 5322 is protruded on an outside wall of one of the side plates 532. The fastening post 5322 defines a screwing hole 53221 through the side plate 532 in an axial direction thereof. The connecting portion 512 of the handle 51 defines a screw hole 5122 corresponding to the screwing hole 53021. Specifically, the control member 54 is configured to pass through the screwing hole 53221 of the side plate 532 and screwed in the screw hole 5122 of the handle 51. The control member 54 may be a screw or a pin. Thus, in a process of assembly, disassembly or normal office use of the gas-operated lifting table 100, the handle 51 may be secured on the fastening seat 53 by the control member 54, thus avoiding the user's misoperation of the handle 51, which causes the moving member 57 to trigger the lifting and falling of the controllable gas spring 3, and causes inconvenience in operation. In addition, in a process adjusting a height of the gas-operated lifting table 100, the control member 54 is operated to move away from the handle 51 and unlock the fastening seat 53, thus the handle 51 may be movable relative to the fastening seat 53.

The cord 55 includes a pull wire 551 and a pull rod 552 arranged on an end of the pull wire 551 away from the handle 51. One end of the pull wire 551 is fixedly connected to the handle 51, and the other end of the pull wire 551 is fixedly connected to the pull rod 552. The cord 55 is connected to the moving member 57 by the pull rod 552. In an alternative embodiment, an extending direction of the pull rod 552 is substantially perpendicular to a central axis of the pull wire 551. The cord 55 further includes a sheath 553 sleeved on the pull wire 551 and two limit joints 554 arranged at two opposite ends of the sheath 553. Each of the limit joints 554 includes a body 5541 and two annular stop rings 5542 arranged on an outside of the body 5541 at intervals. A baffle 413 is arranged at a position of the mounting seat 41 adjacent to the two pivoting portions 411. The baffle 413 and the back plate 533 are respectively arranged between the two stop rings 5542. Thus, the pull wire 551 of the cord 55 is covered by the sheath 553 to protect the pull wire 551 from abrasion. Furthermore, each of the limit joints 554 limits the pull wire 551 at a preset position of the panel bracket 40, thus the pull wire 551 is difficult to bent during assembly or disassembly, and thereby improving the service life of the pull wire 551. A top of the baffle 413 defines a through hole 4131. The top of the baffle 413 is further defines a limiting hole 4132 in air communication with the through hole 4131. The body 5541 of the limit joints 554 can pass through the limiting hole 4132 of the baffle 413, and be latched in the through hole 4131.

The moving member 57 is rotatably connected to the two pivoting portions 411 of the panel bracket 40 by the rotating shaft 56. The moving member 57 includes an abutting portion 571 abutting against the controllable gas spring 3 and a mounting portion 572 latched the pull rod 552 of the cord 55. The mounting seat 41 defines an opening 412 at a position corresponding to the controllable gas spring 3. In the embodiment of the present disclosure, the third opening is the opening 412. In an alternative embodiment, the opening 412 is located between the two pivoting portions 411 and corresponds to the abutting portion 571, thus the abutting portion 571 can pass through the opening 412 to press against the pneumatic valve 31 of the controllable gas spring 3.

A shaft hole 573 for passing through the rotating shaft 56 is defined at a junction of between the abutting portion 571 and the mounting portion 572. A limit block 561 is also arranged at both ends of the rotating shaft 56. The limiting block 561 is configured to stop the shaft hole of the limiting plate 411. An angle is formed between the abutting portion 571 and the mounting portion 572. In the embodiment, the angle is an obtuse angle. An end of the mounting portion 572 defines an opening 5711 engaging with the pull rod 552. The end of the mounting portion 572 defines a limiting recess 5712 in air communication with the opening 5711 in the axial and radial direction of the opening 5711. The pull wire 551 adjacent to the pull rod 552 passes through the limiting groove 5712, and the pull rod 552 is inserted into the opening 5711, thus the pull rod 552 is mounted on the moving member 57.

Referring to FIG. 1 to FIG. 13 together, in the assembly of the gas-operated lifting table 100, the controllable gas spring 3 is mounted on the column assembly 2, and then the pedestal 1, the assembled column assembly 2, the controllable gas spring 3, and the panel assembly 4 are fixedly connected together by the screwing members 5. Specifically, in the assembly of the column assembly 2, the first guide rail 221 is fixed to the outside wall of the fastening column 21, the plurality of ball bearings 2222 are mounted on the mounting plate 2221, and a side of the mounting plate 2221 of the second guide rail 222 away from the plurality of ball bearings 2222 is fixed to a bottom of the inside wall of the sliding column 23. The assembled sliding column 23 is sleeved on the assembled fastening column 21, to make the ball bearing 2222 of the second guide rail 222 is engaged with the guide bar 2211 of the first guide rail 221. A sealing cover 251 is fixed to the top of the sleeve 25, and a bar frame 252 is mounted to the outside wall of the sleeve 25. The assembled sleeve 25 is sleeved on the sliding column 23. The supporting plate 231 is fixed to the sliding column 23.

In the process assembling the controllable gas spring 3, the bottom end of the adjusting rod 32 of the controllable gas spring 3 is fixed to the positioning plate 211 of the fastening column 21 by the first connecting member 301, and the top end of the adjusting rod 32 is fixed to the supporting plate 231 of the slide column 23 by the second connecting member 302, thus the controllable gas spring 3 is detachably mounted to the column assembly 2. The positioning plate 211 of the column assembly 2 is received in the receiving slot 101 of the pedestal 1 and locked to the pedestal 1 by the plurality of fasteners 5. In the process assembling the panel assembly 4, the moving member 57 is mounted to the two pivoting portions 411 of the panel bracket 40 by the rotating shaft 56, one end of the cord 55 is fixed to the handle 51, and the other end of the cord 55 is fixed to the moving member 57. The handle 51 is fixed to the handle holder 53, and the handle holder 53 is fixed on the back surface of the panel 60 by the fastener 501. The panel bracket 40 is mounted to the panel 60 to achieve the assembly of the panel assembly 4. The assembled panel assembly 4 is mounted on the supporting plate 231 of the column assembly 2 by the plurality of fasteners 5, thereby completing the assembly of the gas-operated lifting table 100. It will be appreciated that, in some embodiments, the assembly of the column assembly 2, the controllable gas spring 3 and the panel assembly 4 can be assembled simultaneously.

Referring to FIG. 2, FIG. 11, FIG. 14 and FIG. 15, in use, the control member 54 is operated to unlock the handle 51 and the handle fixing seat 53, and at this time, the handle 51 is movable relative to the handle fixing seat 53. An external force is applied to the handle 51, the handle 51 pulls the cord 55, and the mounting portion 572 of the moving member 57 is pulled by the pull rod 552 to move toward the handle 51. When the abutting portion 571 of the moving member 57 passes through the opening 412 to press against the pneumatic valve 31 of the controllable gas spring 3, the pneumatic valve 31 of the controllable gas spring 3 is stretched into the adjusting rod 32, that is, the pneumatic valve 31 is movable relative to the adjusting rod 32 toward a side close to the pedestal 1, the adjusting rod 32 of the controllable gas spring 3 slides relative to the adjusting sleeve 33, to make the controllable gas spring 3 drive the sliding column 23 movable relative to the fastening column 21 in a direction away from the pedestal 1. At this time, the slide column 23 is in a sliding state. It will be appreciated that, the user can adjust a sliding distance of the sliding column 23 relative to the fastening column 21 according to a sliding distance of the adjusting rod 32 of the controllable gas spring 3 relative to the adjusting sleeve 33, that is, the height at which the gas-operated lifting table 100 lifts.

When the gas-operated lifting table 100 is lifted to a preset working position, stop applying the external force to the handle 51. At this time, the pneumatic valve 31 of the controllable gas spring 3 is reset and abuts against the abutting portion 571, and the abutting portion 571 is in an initial state, that is, the abutting portion 571 is located above the opening 412, and the controllable gas spring 3 is inactive (that is, the adjusting rod 32 is inactive relative to the adjusting sleeve 33). The controllable gas spring 3 can support the sliding column 23 of the column assembly 2 to make the sliding column 23 in an inactive state, thereby realizing the height adjustment of the gas-operated lifting table 100. The control member 54 is operated to lock the handle 51 to the fastening seat 53. At this time, the handle 51 is inactive relative to the fastening seat 53, thus avoiding the user's misoperation of the handle 51, which causes the controllable gas spring 3 to lift, and thereby ensuring the stability and safety of the gas-operated lifting table 100 in an office use state. It will be appreciated that, when the gas-operated lifting table 100 needs to reset or lower a current height of the gas-operated lifting table 100, a first external force is applied to the handle 51, and a second external force is applied to the panel 60 of the panel assembly 4 to reset or lower the gas-operated lifting table 100 to a preset position. In the embodiment, the second external force applied to the panel 60 of the panel assembly 4 in direction is opposite to the sliding column 23 lifts relative to the fastening column 21 in direction, and the second external force applied to the panel 60 of the panel assembly 4 is greater than the elastic force of the controllable gas spring 3.

Figure 16:
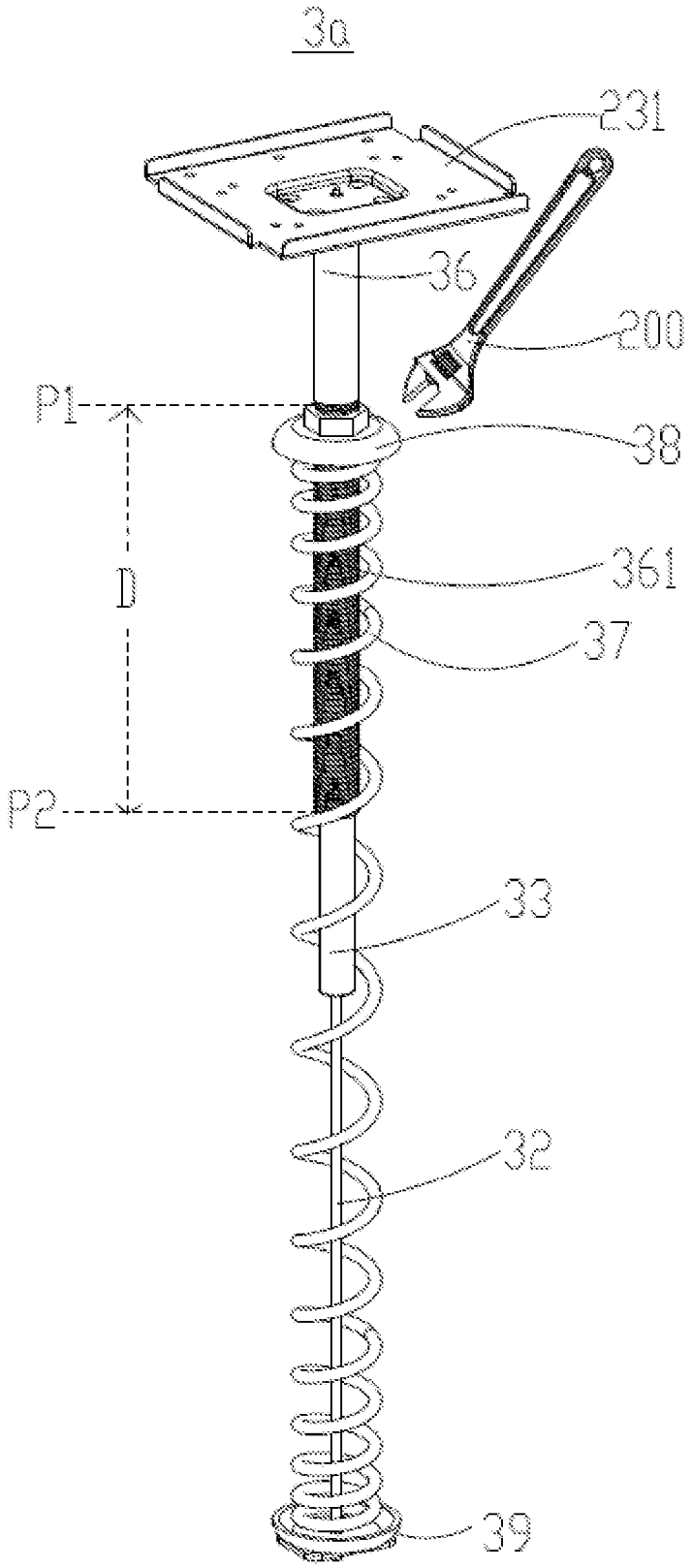
FIG. 16 is a schematic structural view of a controllable gas spring of a gas-operated lifting table provided by another exemplary embodiment of the present disclosure.
Figure 17:
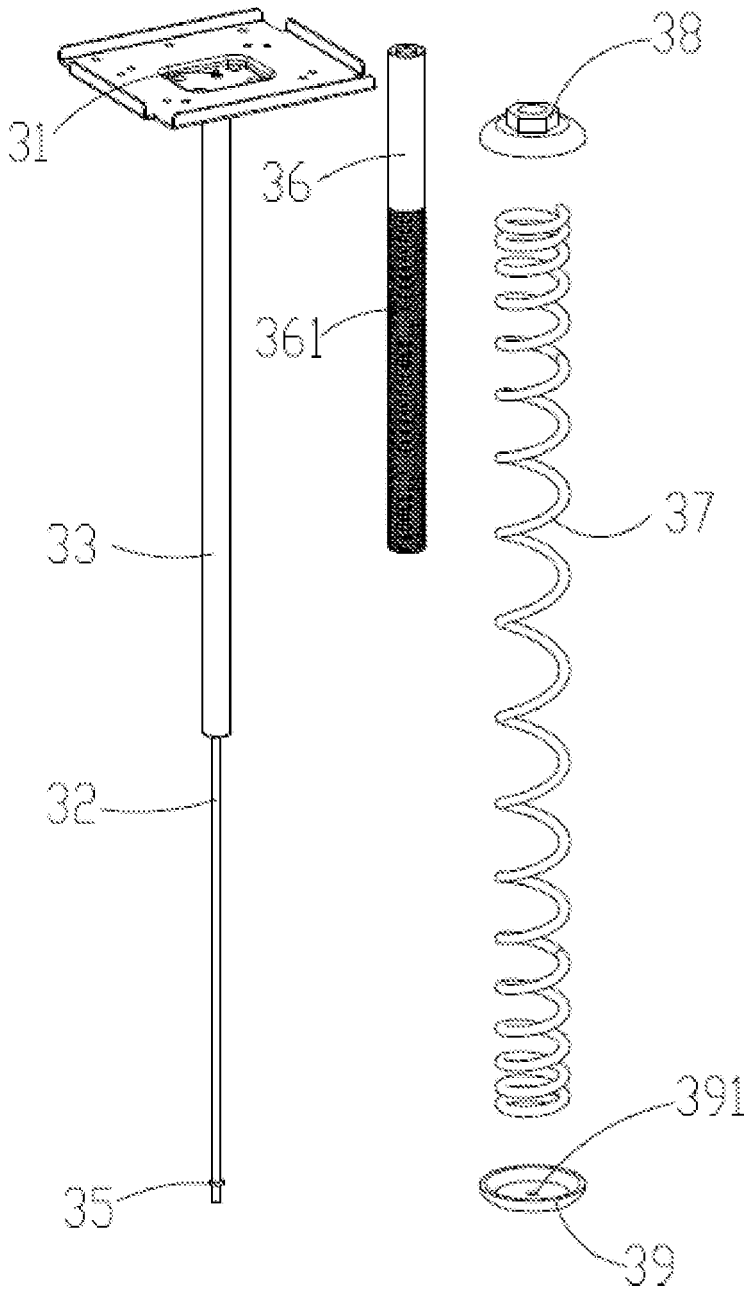
FIG. 17 is an exploded perspective view of the controllable gas spring of the gas-operated lifting table of FIG. 16.

As illustrated to FIG. 16 and FIG. 17, FIG. 16 and FIG. 17 are schematic diagrams showing another structure of the controllable gas spring 3*a*. The structure of the controllable gas spring 3*a* is similar to the structure of the controllable gas spring 3 in the above embodiment. The controllable gas spring 3*a* includes a resettable pneumatic valve 31, an adjusting rod 32, an adjusting sleeve 33, a positioning nut, and a cushioning pad 35. The difference is that the controllable gas spring 3*a* further includes a sleeve pipe 36 arranged an outside the adjusting sleeve 33, a mechanical spring 37, an adjusting nut 38, and a washer 39. The adjusting nut 38 and the washer 39 are arranged on an outside the sleeve pipe 36. The sleeve pipe 36 is sleeved on the adjusting sleeve 33. The sleeve pipe 36 can be fixed to the adjusting sleeve 33 by welding, gluing or the like. The adjusting nut 38 is movable relative to the sleeve pipe 36 to regulate an elastic force of the mechanical spring 37. Specifically, the outside wall of the sleeve pipe 36 defines an external thread 361 cooperating with an internal thread of the adjusting nut 38. The external thread 361 is arranged at one end of the sleeve pipe 36 away from the supporting plate 231. The mechanical spring 37 is arranged between the adjusting nut 38 and the washer 39. The washer 39 is fixed to a bottom of the adjusting rod 32 by a positioning nut. It will be appreciated that. in the embodiment, both ends of the mechanical spring 37 are stopped by the adjusting nut 38 and the washer 39, respectively. An outer diameter of the mechanical spring 37 is substantially smaller than an outer diameter of the adjusting nut 38 and an outer diameter of the washer 39, thus the mechanical spring 37 may be arranged between the adjusting nut 38 and the washer 39. The washer 39 defines an opening 391 for passing through the adjusting rod 32. The cushioning pad 35 is stopped by the cushioning pad 35 of the washer 39.

Alternatively, in some embodiments, the outside wall of the adjusting sleeve 33 arranges an external thread cooperating with the internal thread of the adjusting nut 38, that is, the sleeve pipe 36 can be omitted to save cost. The adjusting nut 38 is movable relative to the adjusting sleeve 33 to adjust the elastic force of the mechanical spring 37.

It will be appreciated that, different types of the controllable gas springs 3 have different elastic force. The elastic force of the factory of the controllable gas springs 3 are usually fixed. In the embodiment of the present disclosure, the elastic force of the mechanical spring 37 is adjusted to increase an overall elastic force of the controllable gas spring 3*a*, thus the weight of the gas-operated lifting table 100 may be increased, and thereby ensuring the stability of the gas-operated lifting table 100. In the embodiment, the elastic force the mechanical spring 37 is substantially in a range of about 0 kg to 10 kg. Specifically, in the embodiment, the sleeve pipe 36 includes a first position P1 and a second position P2. When the adjusting nut 38 is at the first position P1, the mechanical spring 37 is in an initial state (that is, in an un-stretched state). The mechanical spring 37 has the smallest elastic force value, and the elastic force of the mechanical spring 37 is 0 kg. The force between the adjusting sleeve 33 and the adjusting rod 32 is the elastic force of the controllable gas spring 3*a* itself. When the adjusting nut 38 is moved from the first position P1 to the second position P2, the mechanical spring 37 is in a compressed state. At this time, the elastic force of the mechanical spring 37 is the largest, and the elastic force value is 10 kg. At this time, a force of the adjusting sleeve 33 relative to the adjusting rod 32 is substantially equal to the elastic force of the controllable gas spring 3*a* itself plus the elastic force of the mechanical spring 37. Thus, the elastic force of the mechanical spring 37 can be adjusted correspondingly by adjusting a position of the adjusting nut 38 relative to the sleeve pipe 36. Specifically, when the adjusting nut 38 is moved from the first position P1 toward the second position P2, the elastic force of the mechanical spring 37 is gradually increased; when the adjusting nut 38 is moved from the second position P2 toward the first position P1, the elastic force of the mechanical spring 37 gradually decreases. A distance between the first position P1 and the second position P2 is represented as D, and D=200 mm. It will be appreciated that, in the embodiment, the first position P1 refers to a position of the adjusting nut 38 screwed to the sleeve pipe 36 and closest to the supporting plate 231, and the second position P2 refers to a position of the adjusting nut 38 is screwed to the sleeve pipe 36 farthest from the supporting plate 231. It will be appreciated that, in the embodiment, a length of the mechanical spring 37 may be adjusted by operating the adjusting nut 38 to achieve an adjustment of the elastic force of the mechanical spring 37, thus increasing the overall elastic force of the controllable gas spring 3*a*, and thereby ensuring the stability of the gas-operated lifting table 100. Therefore, the structure of the gas-operated lifting table 100 is not only simple, but also it is easy to operate.

In the embodiment, the adjusting nut 38 can be rotated relative to the sleeve pipe 36 by a rotating device 200. In the embodiment, the rotating device 200 is a wrench. Since the controllable gas spring 3*a* is detachably connected to the column assembly 2, the user can disassembly the first connecting member 301 from the positioning plate 211 and disassembly the second connecting member 302 from the supporting plate 231, thus the controllable gas spring 3*a* may be taken out. The user can adjust the position of the adjusting nut 38 relative to the sleeve pipe 36 according to the actual situation. For example, when the elastic force of the controllable gas spring 3*a* is small, the adjusting nut 38 can be adjusted to the second position P2 or a position close to the second position P2 to increase the overall elastic force of the controllable gas spring 3*a*, and thereby ensuring the stability of the gas-operated lifting table 100. When the elastic force of the controllable gas spring 3*a* is large, the adjusting nut 38 can be adjusted to the first position P1 or a position close to the first position P1, thus ensuring the stability of the pneumatic lifting table 100 simultaneously, and conveniently adjusting the height of the gas-operated lifting table 100 by applying a small force to the panel assembly 4. Referring to FIG. 1 to FIG. 17, furthermore, in some embodiments, the controllable gas spring 3*a* further includes a rotary device (not shown) rotatably connected to the adjusting nut 38. In the embodiment, the rotary device is an eccentric wheel. It will be appreciated that, in other embodiments, the rotary device can also be a drive motor. One end of the rotary device is fixedly connected to the rope 53, and the rope 53 is linked with the handle 51. A rotary direction of the rotary device is opposite to a rotary direction of the adjusting nut 38.

The gas-operated lifting table is provided by the embodiment of the present disclosure. The column assembly is detachably connected to the pedestal and the panel assembly, the panel assembly includes a operating member, the column assembly includes a fastening column fastened to the pedestal and a sliding column movable relative to the fastening column, the gas-operated lifting table further includes a controllable gas spring arranged within the column assembly and detachably connected to the column assembly, when the operating member is pressed against the controllable gas spring, the sliding column is movable relative to the fastening column in a direction away from or toward the pedestal. Since the controllable gas spring is detachably coupled to the column assembly and isolated from the operating member, the gas-operated lifting table may have a simple structure and may be easy to install and disassemble. In addition, the height of the gas-operated lifting table can be adjusted at any position within the adjustable range by the controllable gas spring to adapt to the application needs of different occasions.

The embodiments of the present disclosure are described in detail above, specific examples are used herein to describe the principle and implementation manners of the present disclosure. The description of the above embodiments is merely used to help understand the method and the core idea of the present disclosure. Meanwhile, those skilled in the art may make modifications to the specific implementation manners and the application scope according to the idea of the present disclosure. In summary, the contents of the specification should not be construed as limiting the present disclosure.

What is claimed is:

1. A gas-operated lifting table comprising: a pedestal, a column assembly, and a panel assembly, wherein the column is detachably coupled to the pedestal and the panel assembly, the panel assembly comprises an operating member, the column assembly comprises a fastening column fastened to the pedestal and a sliding column movable relative to the fastening column, the gas-operated lifting table further comprises a controllable gas spring arranged within the column assembly and detachably coupled to the column assembly, and when the operating member is pressed against the controllable gas spring, the sliding column is movable relative to the fastening column in a direction away from or toward the pedestal; wherein, the sliding column is sleeved on the fastening column, the column assembly further comprises a first guide rail and a second guide rail engaging with the first guide rail, the first guide rail is arranged on an outside wall of the fastening column, the second guide rail is arranged on an inside wall of the sliding column and located at an end of the sliding column adjacent to the pedestal; wherein, the second guide rail comprises a mounting plate and at least two ball bearings arranged on a side of the mounting plate away from the sliding column, and the first guide rail is arranged between the at least two ball bearings and slidably engaged with the at least two ball bearings.

2. The gas-operated lifting table of the claim 1, wherein two guide strips are respectively arranged on two opposite sides of the first guide rail along a length direction of the first guide rail, and a side wall of each of the ball bearings defines a groove engaging with the corresponding guide strip.

3. The gas-operated lifting table of the claim 1, wherein an adjusting member is arranged on a side of the mounting plate adjacent to the sliding column, and the adjusting member is configured to adjust a distance between the first guide rail and the second guide rail.

4. The gas-operated lifting table of the claim 1, wherein the column assembly further comprises a sleeve and a sealing cover arranged at an end of the sleeve away from the pedestal, the sleeve is coaxially arranged with the sliding column and the fastening column, the sliding column is arranged between the sleeve and the fastening column, the sealing cover is sleeved on the sliding column and configured to shield a gap between the sleeve and the sliding column.

5. The gas-operated lifting table of the claim 1, wherein the fastening column is fastened on the pedestal by a positioning plate, and the sliding column is fastened on the panel assembly by a supporting plate, and when the sliding column moves relative to the fastening column away from or toward the pedestal, the panel assembly is moved in a direction away from or toward the pedestal to change a height of the gas-operated lifting table.

6. The gas-operated lifting table of the claim 5, wherein a bottom end of the controllable gas spring is detachably coupled to the positioning plate by a first connecting member, and a top end of the controllable gas spring is detachably coupled to the supporting plate by a second connecting member.

7. The gas-operated lifting table of the claim 6, wherein the positioning plate defines a first opening, a bottom end of the controllable gas spring is passed through the first opening and fixedly coupled to the first connecting member, the supporting plate defines a second opening, and a top end of the controllable gas spring is passed through the second opening and fixedly coupled to the second connecting member.

8. The gas-operated lifting table of the claim 7, wherein a maximum outer diameter of the controllable gas spring is smaller than a diameter of the second opening.

9. The gas-operated lifting table of the claim 7, wherein a receiving groove is recessed at a top portion of the supporting plate, and the second connecting member is received in the receiving groove.

10. The gas-operated lifting table of the claim 1, wherein the panel assembly further comprises a panel and a panel bracket supporting the panel, one end of the operating member is coupled to the panel bracket, and the other end of the operating member is coupled to the panel.

11. The gas-operated lifting table of the claim 10, wherein the operating member comprises a handle, a cord, and a moving member, the cord is coupled between the handle and the moving member, and the moving member is linked with the handle by the cord, and configured to make the controllable gas spring drive the sliding column to move relative to the fastening column.

12. The gas-operated lifting table of the claim 11, wherein the operating member further comprises a fastening seat, the handle is movably mounted on the fastening seat, and the fastening seat is fastened to the panel.

13. The gas-operated lifting table of the claim 12, wherein the operating member further comprises a control member, and the handle is in a locked state or an unlocked state relative to the fastening seat by operating the control member.

14. The gas-operated lifting table of the claim 11, wherein two opposite pivoting portions are arranged at a position of the panel bracket corresponding to the column assembly, the moving member is coupled to the two pivoting portions, a pull rod is arranged at an end of the cord away from the handle, the moving member comprises an abutting portion and a mounting portion, the pull rod is coupled to the mounting portion, and the controllable gas spring comprises a return pneumatic valve exposed to the column assembly, the panel bracket defines a third opening for passing the pneumatic valve, and the abutting portion is opposite to the third opening.

15. The gas-operated lifting table of the claim 14, wherein when the handle is in a stressed state, the pull rod pulls the mounting portion toward the handle, the abutting portion passes through the third opening to press against the pneumatic valve, to make the controllable gas spring drive the sliding column to move away from or toward the pedestal relative to the fastening column; when the handle is in an unstressed state, the pneumatic valve resets and abuts against the abutting portion, to make the abutting position locate above the third opening, and make the controllable gas spring to be inactive.

16. The gas-operated lifting table of the claim 14, wherein the controllable gas spring further comprises an adjusting rod and an adjusting sleeve slidably coupled to the adjusting rod, the adjusting sleeve is sleeved on the adjusting rod, and the pneumatic valve is telescopically arranged in the adjusting rod, and exposed to the column assembly.

17. The gas-operated lifting table of the claim 16, wherein the controllable gas spring further comprises an adjusting nut and a mechanical spring, which are sleeved on an outside of the adjusting sleeve, and a washer fastened to a bottom of the adjusting rod, the mechanical spring is arranged between the adjusting nut and the washer, and the adjusting nut is movable relative to the adjusting sleeve to adjust an elastic force value of the mechanical spring.

18. The gas-operated lifting table of the claim 17, wherein the controllable gas spring further comprises a sleeve pipe sleeved on the outside the adjusting sleeve, and the adjusting nut is screwed to the sleeve, the sleeve has a first position and a second position, and when the adjusting nut moves from the first position toward the second position, the elastic force value of the mechanical spring gradually increases.

19. A gas-operated lifting table comprising: a pedestal, a column assembly, and a panel assembly, wherein the column is detachably coupled to the pedestal and the panel assembly, the panel assembly comprises an operating member, the column assembly comprises a fastening column fastened to the pedestal and a sliding column movable relative to the fastening column, the gas-operated lifting table further comprises a controllable gas spring arranged within the column assembly and detachably coupled to the column assembly, and when the operating member is pressed against the controllable gas spring, the sliding column is movable relative to the fastening column in a direction away from or toward the pedestal; the fastening column is fastened on the pedestal by a positioning plate, and the sliding column is fastened on the panel assembly by a supporting plate, and when the sliding column moves relative to the fastening column away from or toward the pedestal, the panel assembly is moved in a direction away from or toward the pedestal to change a height of the gas-operated lifting table; a bottom end of the controllable gas spring is detachably coupled to the positioning plate by a first connecting member, and a top end of the controllable gas spring is detachably coupled to the supporting plate by a second connecting member.

20. A gas-operated lifting table comprising: a pedestal, a column assembly, and a panel assembly, wherein the column is detachably coupled to the pedestal and the panel assembly, the panel assembly comprises an operating member, the column assembly comprises a fastening column fastened to the pedestal and a sliding column movable relative to the fastening column, the gas-operated lifting table further comprises a controllable gas spring arranged within the column assembly and detachably coupled to the column assembly, and when the operating member is pressed against the controllable gas spring, the sliding column is movable relative to the fastening column in a direction away from or toward the pedestal; the panel assembly further comprises a panel and a panel bracket supporting the panel, one end of the operating member is coupled to the panel bracket, and the other end of the operating member is coupled to the panel; the operating member comprises a handle, a cord, and a moving member, the cord is coupled between the handle and the moving member, and the moving member is linked with the handle by the cord, and configured to make the controllable gas spring drive the sliding column to move relative to the fastening column; two opposite pivoting portions are arranged at a position of the panel bracket corresponding to the column assembly, the moving member is coupled to the two pivoting portions, a pull rod is arranged at an end of the cord away from the handle, the moving member comprises an abutting portion and a mounting portion, the pull rod is coupled to the mounting portion, and the controllable gas spring comprises a return pneumatic valve exposed to the column assembly, the panel bracket defines a third opening for passing the pneumatic valve, and the abutting portion is opposite to the third opening.

* * * * *